US006571855B1

(12) United States Patent
Goldsmith et al.

(10) Patent No.: US 6,571,855 B1
(45) Date of Patent: Jun. 3, 2003

(54) FLATTENER APPARATUS FOR A MOVABLE WALL SYSTEM

(75) Inventors: Thomas Goldsmith, Earlville, IA (US); Jeff Kronlage, Dyersville, IA (US); Steve Helbing, Dubuque, IA (US)

(73) Assignee: Modernfold, Inc., New Castle, IN (US)

( * ) Notice: Subject to any disclaimer, the term of this patent is extended or adjusted under 35 U.S.C. 154(b) by 0 days.

(21) Appl. No.: 10/109,570

(22) Filed: Mar. 28, 2002

(51) Int. Cl.[7] ..... E05D 15/26
(52) U.S. Cl. ..... 160/199; 160/40
(58) Field of Search ..... 160/199, 206, 160/201, 196.1, 40, 183; 49/127, 130, 409; 52/64; 16/87.4 R, 87.6 R, 95 R, 95 D

(56) References Cited

U.S. PATENT DOCUMENTS

| | | | | | |
|---|---|---|---|---|---|
| 3,374,821 | A | * | 3/1968 | White | 160/206 X |
| 3,448,786 | A | * | 6/1969 | Edgerton | 160/206 X |
| 3,529,651 | A | * | 9/1970 | Bender | 160/183 |
| 3,755,968 | A | * | 9/1973 | Williams | 160/40 |
| 3,783,930 | A | * | 1/1974 | Williams | 160/199 |
| 4,014,137 | A | * | 3/1977 | Williams | 49/130 X |
| 4,106,544 | A | * | 8/1978 | Dixon et al. | 160/199 |
| 4,159,556 | A | | 7/1979 | Dickson | |
| 4,401,033 | A | | 8/1983 | Gerken | |
| 4,569,164 | A | | 2/1986 | Dickson | |
| 4,642,947 | A | | 2/1987 | Dickson | |
| 4,752,987 | A | | 6/1988 | Dreyer et al. | |
| 4,837,891 | A | | 6/1989 | Toma et al. | |
| 5,016,318 | A | | 5/1991 | Harris | |
| 5,152,332 | A | | 10/1992 | Siener | |
| 5,499,671 | A | | 3/1996 | Owens | |
| 5,544,462 | A | | 8/1996 | Kordes | |
| 6,098,695 | A | | 8/2000 | Schwingle | |

* cited by examiner

*Primary Examiner*—David Purol
(74) *Attorney, Agent, or Firm*—Baker & Daniels

(57) ABSTRACT

The present invention involves a flattener apparatus for a movable wall system that eliminates misalignment, drifting and binding of the wall panels in the extended wall-forming position. The flattener apparatus holds movable wall panels of a movable wall panel system in an extended aligned orientation along the length of the track thereof. The flattener apparatus includes a flattener member extending along a portion of the track. The flattener member has a base flange attached at the bottom of the track assembly and a relatively transverse guide flange depending vertically downward from the base flange. A sealing sweep extends along a portion of the top end of the movable wall panels. A guide pin protrudes from the top end of the movable wall panels. The sealing sweep and the guide pin define opposite sides of a vertical channel for receiving the guide flange portion of the flattener member as the wall panels are extended toward the portion of the track having the flattener member attached.

16 Claims, 5 Drawing Sheets

FLATTENER APPARATUS FOR A MOVABLE WALL SYSTEM

BACKGROUND OF THE INVENTION

1. Field of the Invention

The present invention pertains to operable wall panels movable to partition large rooms into smaller rooms.

2. Description of the Related Art

Operable walls or partitions, also known as movable wall panel systems, find useful application in a variety of venues, such as classrooms, offices, convention centers, hospitals, etc. In these venues, the operable walls can be utilized to efficiently divide or compartmentalize interior space into a multitude of separate, smaller rooms. In particular, the operable wall panels are typically connected by a hanging device to trolleys that roll within an overhead track. Travel of the trolleys within the track allows the panels to be moved between a stacked arrangement in a storage location, and a wall-forming, extended arrangement in alignment with the overhead track.

One type of movable wall panel system is a continuously hinged system in which each operable panel is typically hinged to adjacent panels. Continuously hinged wall panel systems are frequently electrically driven between stacked and extended positions. When arranged in a proper stacked position, the operable partitions are folded over one another accordion style with each panel being oriented generally transverse to an overhead track. Also included in some systems of this type is a lead panel swing or latch device that swings open the lead panel to a straight wall-forming position as it is propelled from the stacked position.

To aid in forming and maintaining a straight wall, some movable wall panel systems include a guide rail or angular member along both sides of the track, thus forming a channel that guides the top of the wall panels. However, the top of the wall panels often jam or bind in channels having a guide rail on both sides of the track.

Alternatively, other movable wall panel systems include only a single guide rail on one side of the track and wall panels. This arrangement, however, does not prevent the wall panels from unfolding toward the unguided side of the track. Some wall panel systems using a single guide rail use guide blocks on the exterior of the panels to form a channel that follows the single guide rail along an exterior side of the panels.

Despite the use of guide blocks, several problems remain with this guide rail configuration. Most components, including the guide rail and blocks, are located on the exterior of the panel and track, and are exposed when the wall is in both the extended and the stacked position. This arrangement causes exterior pinch points, protruding and visible components, and worn finishes on the exposed top portion of the panels and on the exposed guide rail components.

Thus, a need remains for an apparatus that aids in forming and maintaining an extended straight wall of movable wall panels and prevents misalignment, drifting, and binding of the wall panels without the disadvantages of the aforementioned solutions.

BRIEF SUMMARY OF THE INVENTION

The present invention provides a flattener apparatus for a movable wall system having a track assembly. The flattener apparatus includes a flattener member having a base flange attached at the bottom of the track assembly and a guide flange depending vertically downward from the base flange. The flattener apparatus eliminates misalignment, drifting and binding of the wall panel in the extended wall forming position.

According to one aspect of the invention, there is provided a movable wall panel system that includes a track assembly supported between two opposing walls and a plurality of continuously hinged panels movably coupled to the track assembly by hangers. The wall panels may be stowed in a folded stacked position at one end of the track assembly or may be extended and unfolded forming a wall extending along the track assembly. The flattener apparatus provides a means for holding the panels in an extended aligned orientation along the length of the track.

The track assembly includes a stack portion for storing the folded wall panels, an adjacent extension portion where the wall panels are unfolded and extended as they are pulled from the stack, and a remaining portion of the track assembly supporting the wall panels of the extended wall.

In one embodiment, the flattener apparatus includes an angular flattener member having a base flange attached to the bottom of the track assembly and a guide flange depending vertically downward from the base flange. The flattener member spans a portion of the track but does not span the track portion for stacking panels or the track portion for extending wall panels.

The flattener apparatus includes a vertical channel defined by the top end of the wall panels. The vertical channel receives the guide flange of the flattener member as the wall panels are extended toward the portion of the track adjacent the flattener member. Once a wall panel is extended to the flattener member and the guide flange is received in the vertical channel, the wall panel is held aligned with the axis of the track. Thus, the wall panels form a straight wall held in alignment by the flattener apparatus. Because the vertical channel receives the guide flange, the part of the wall panel contacting the guide flange and the guide flange itself are not visible once the wall is extended. Thus, wear and tear on the finishes of the components are not visible and pinch points are eliminated.

In one embodiment, one side of the vertical channel of the flattener apparatus is defined by a sealing sweep that is located along a portion of the top end of the wall panels and adjacent to a face of the wall panel. The other side of the vertical channel is defined by a guide pin protruding vertically from the top end of the panel and located between the sealing sweep and the other opposite face of the wall panel. As a wall panel is unstowed from the storage portion and moved toward the portion of the track having the flattener member, the guide flange is received between the sweep and the guide pin. The end of the sweep may also have a clip to prevent the guide flange from turning the sweep inward toward the guide pin. The guide pin can include a smooth curved surface or can include a wheel or roller rotatably connected to the guide pin.

In another aspect, the flattener member can be an aluminum extruded member having a base flange fastened to the track assembly and a guide flange extending vertically downward along its length. The track assembly includes a slot along its length that is defined by the bottom of the track and is for receiving the hangers which suspend the wall panels from the track. The flattener member is advantageously attached to the track assembly so that the guide flange is located adjacent to one of the sides of the slot. The guide flange is positioned on the side of the track from which the leading edge of the lead wall panel swings off the stack when unstowed and extended.

In a further aspect, the base flange and the guide flange can have adjacent faces for contacting the top and the hidden interior side of the sealing sweep. Thus, as the guide flange engages the channel between the guide pin and the sealing sweep, the flattener apparatus holds the wall panel aligned with the axis of the track and seals the space between the wall panel and the track.

In still another aspect, the flattener member spans a substantial portion of the track assembly, but does not span an area equal to the length of the track occupied by the folded and stored wall panels and the portion of the track used to unfold and extend the panels. The portion of the track used to unfold and extend the panels is about two and one-half times the width of a wall panel.

One object of the invention is to provide a flattener apparatus that can hold the wall panel in a straight wall-forming position, eliminating misalignment, drifting, and binding of the wall panels as they are extended. Another object is to remove apparatus components from view when the movable wall is in the extended position.

The flattener apparatus of the present invention is reliable, has simple, inexpensive components, and is easy to construct and assemble. Because the guide flange is received in a vertical channel defined inside the wall panel, external pinch points and unsightly worn finishes are eliminated.

These and other objects of the present invention will become more apparent from the following description of the exemplary embodiments.

BRIEF DESCRIPTION OF THE SEVERAL VIEWS OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
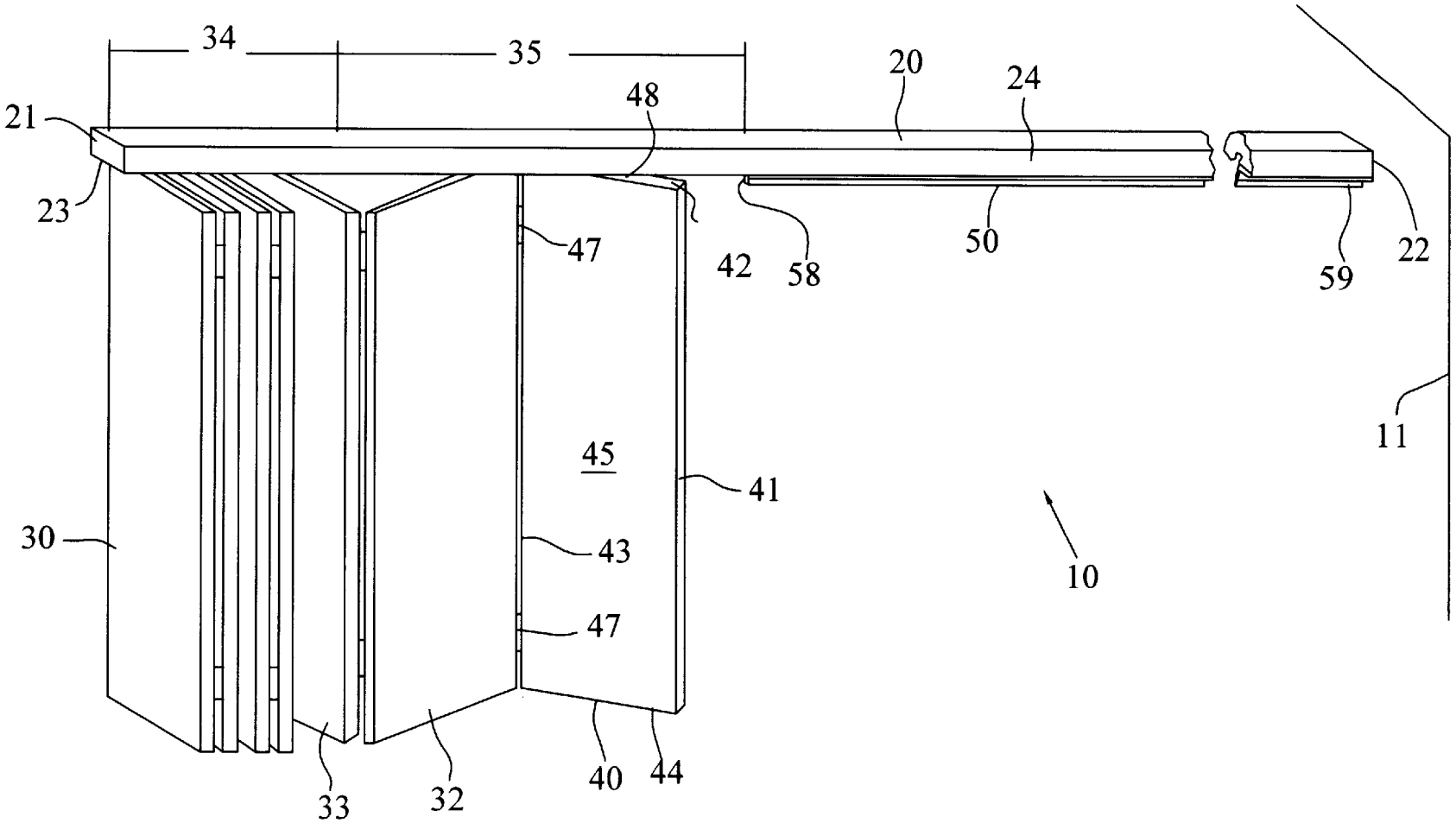
FIG. 1 is a perspective view of a movable wall system having one embodiment of the flattener apparatus.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DETAILED DESCRIPTION OF THE INVENTION

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

In accordance with one embodiment of the invention, the inventive flattener apparatus is used in conjunction with movable wall system 10 as depicted in FIG. 1. A typical movable wall system, also known as a partition, is generally used to divide a room into separate smaller rooms. System 10 consists of track assembly 20 mounted between two opposing walls 11 and along or in ceiling 13. A plurality of continuously hinged wall panels 30 are supported by track assembly 20 and can extend to the floor. Wall panels 30 are generally connected to track assembly 20 by hanger 48. The hanger can be attached to trolley 90, shown in FIG. 3, that rolls within track assembly 20.

When not in use, hinged wall panels 30 fold in an accordion-like fashion and are stored at stack end 21 of track assembly 20, with panels 30 oriented perpendicular to the track as shown in FIG. 1. To extend the wall, lead side 41 of lead panel 40 can be swung open so that it is aligned with track assembly 20 as panel 40 is translated from stack end 21 of track 20 to opposite extended end 22. As lead panel 40 moves, second panel 32, third panel 33, and each adjacent hinged panel will follow until wall panels 30 extends the length of track 20.

Figure 2:
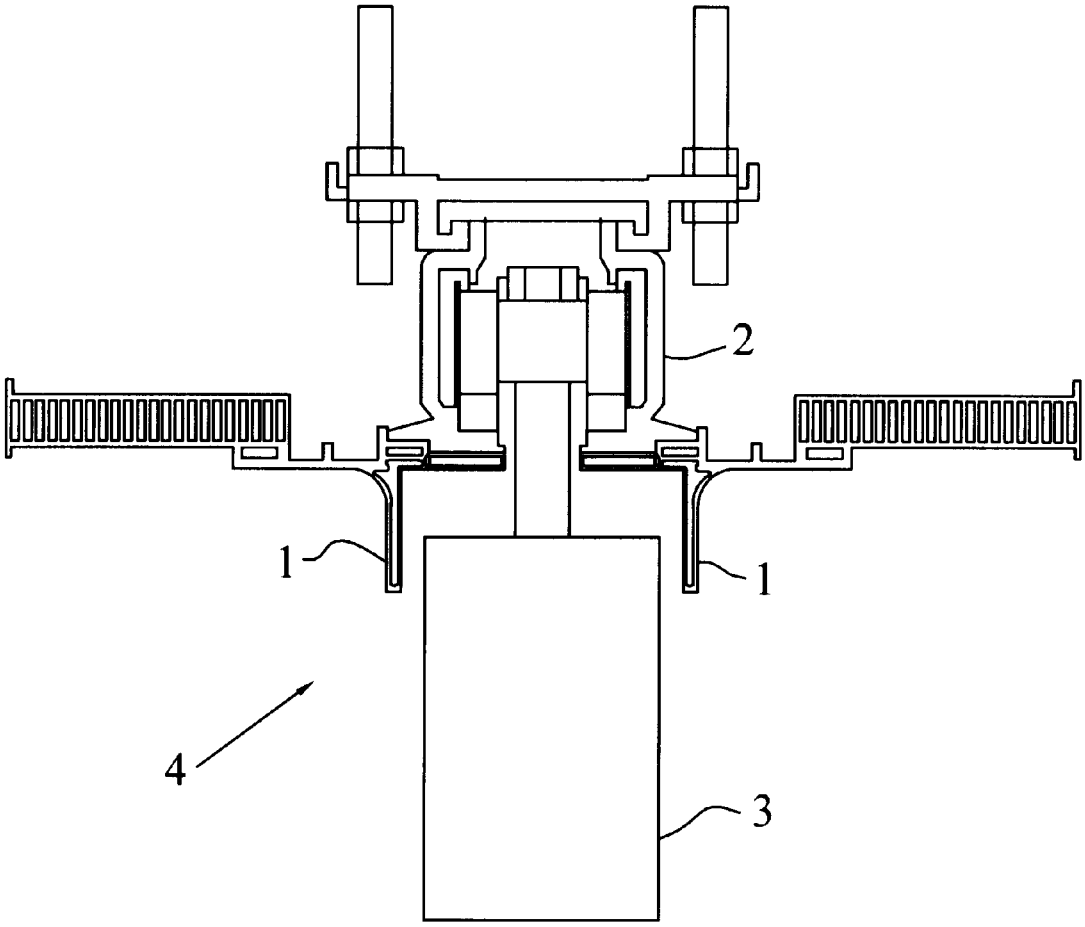
FIG. 2 PRIOR ART
FIG. 2 is a cross-sectional view of a prior art flattener apparatus.

A typical problem with movable wall systems 10 is maintaining wall panels 30 in a straight flat aligned orientation once panels 30 are extended across track 20. A prior art device to attempt to remedy this problem is shown in FIG. 2. Device 4 consists of two guide rails 1 attached to the bottom of track 2, one on each side of extended wall panels 3. Thus, the components of device 4 are exposed to view, even when wall panels 3 are extended.

One embodiment of the flattener apparatus according to the present invention, as depicted in FIGS. 1 and 3–5, includes flattener member 50 attached to the bottom of track 20, as shown in FIG. 1. Flattener member 50 includes guide flange 55 (FIG. 4) along its length. Guide flange 55 protrudes vertically downward toward top end 42 of wall panels 30.

Top ends 42 of wall panels 30 define vertical channel 80 (FIG. 3) that extends along each panel from lead side 41 (FIG. 1) to trailing side 43. Folded wall panels 30 are generally stored under stack portion 34 of track 20 which extends from stack end 21 to approximately the accumulated thickness of stored panels 30. Lead panel 40 and those panels 30 immediately following, extend off of stack portion 34 and are supported by extension portion 35 of track 20. As lead panel 40 and other wall panels 30 unfold and are extended to the open position, panels 30 are generally straight and aligned with track 20 by the time leading edge 41 reaches the end of extension portion 35 of track 20. Flattener member 50 spans track 20 from the end of extension portion 35 to extended end 22.

As each wall panel 30 translates along track 20 toward first end 58 of guide flange 55, guide flange 55 is received into vertical channel 80 defined by top end 42 of wall panel 30. Each progressive wall panel 30 is engaged by guide flange 55 as wall panels 30 are moved to the extended open position toward extended end 22 of track 20 and second end 59 of guide flange 55. Once panel 30 receives a portion of guide flange 55, vertical channel 80 and guide flange 55 cooperate to hold wall panel 30 in an orientation aligned with track 20.

The length of stack portion 34 of track 20 is approximately equal to at least about the accumulated thickness of all wall panels 30 in a folded and stacked orientation. In the exemplary embodiment, the length of stack portion 34 is about nine inches greater than the accumulated thickness of all of the wall panels 30 in the stacked orientation.

The length of extension portion 35 of track 20 in the exemplary embodiment is preferably equal to at least about 2.5 times the width of one extended wall panel 30 from leading side 41 to trailing side 43. Improved operation of the movable wall system with the flattener apparatus is achieved using a similar ratio of extension portion length to wall panel width. The length of extension portion 35 is the distance required by movable wall system 10 for lead panel 40 to fully swing open and extend aligned with track 20 as it translates from the stacked to the extended wall-forming position.

It is desirable that panels 30 be aligned with track 20 before reaching guide flange 55 so that guide flange 55 is properly aligned with vertical channel 80 defined by top end 42 of wall panels 30. According to one embodiment of the present invention, wall panel systems 10 may include a mechanism (not shown) that automatically swing panels 30 to an open orientation aligned with track 20 as panels 30 are extended toward second end 22 of track 20. Another mechanism (not shown) retains panel 30 in that orientation until engaging flattener member 50.

Figure 3:
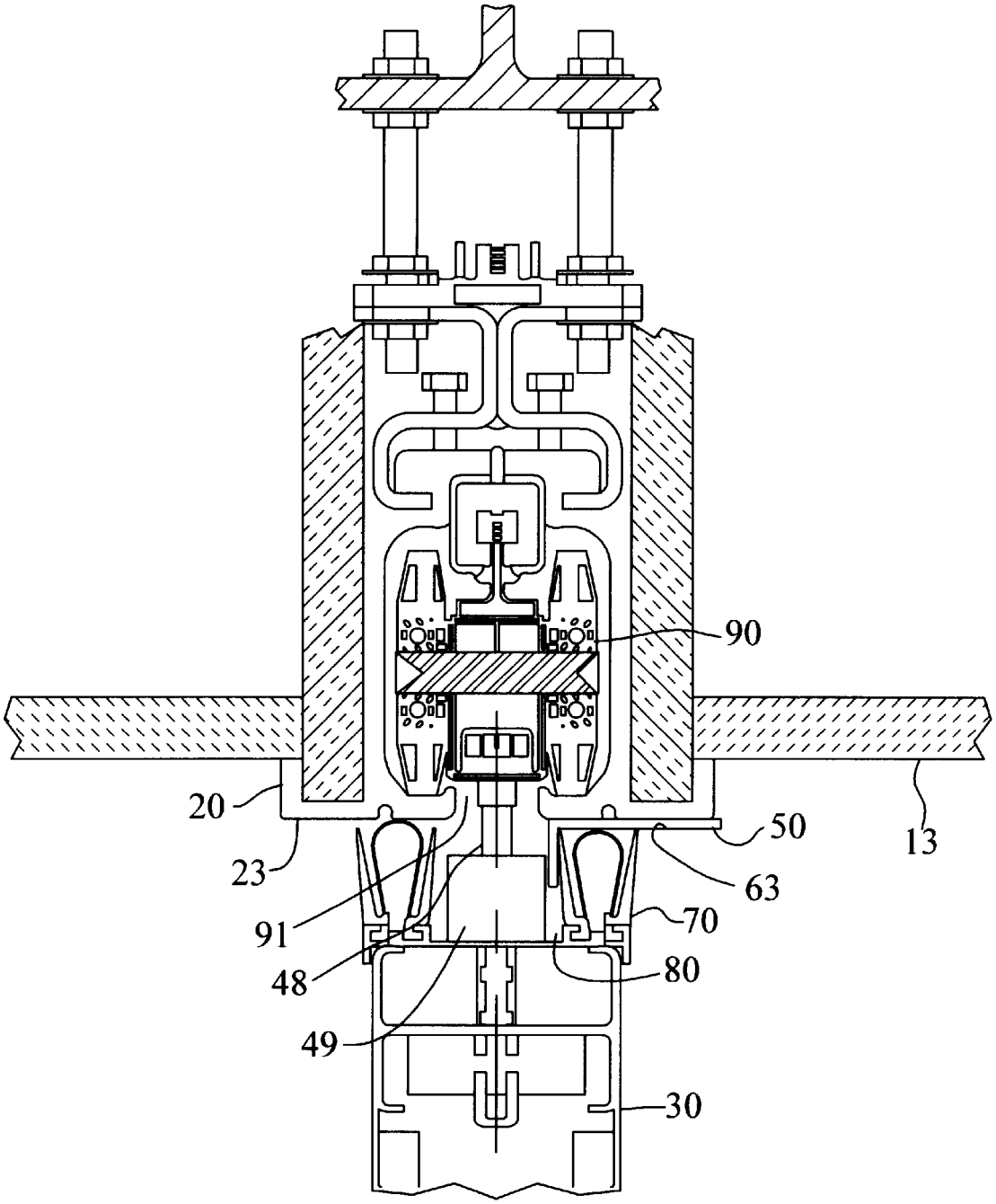
FIG. 3 is a cross-sectional view of a movable wall system having one embodiment of the flattener apparatus.
Figure 5:
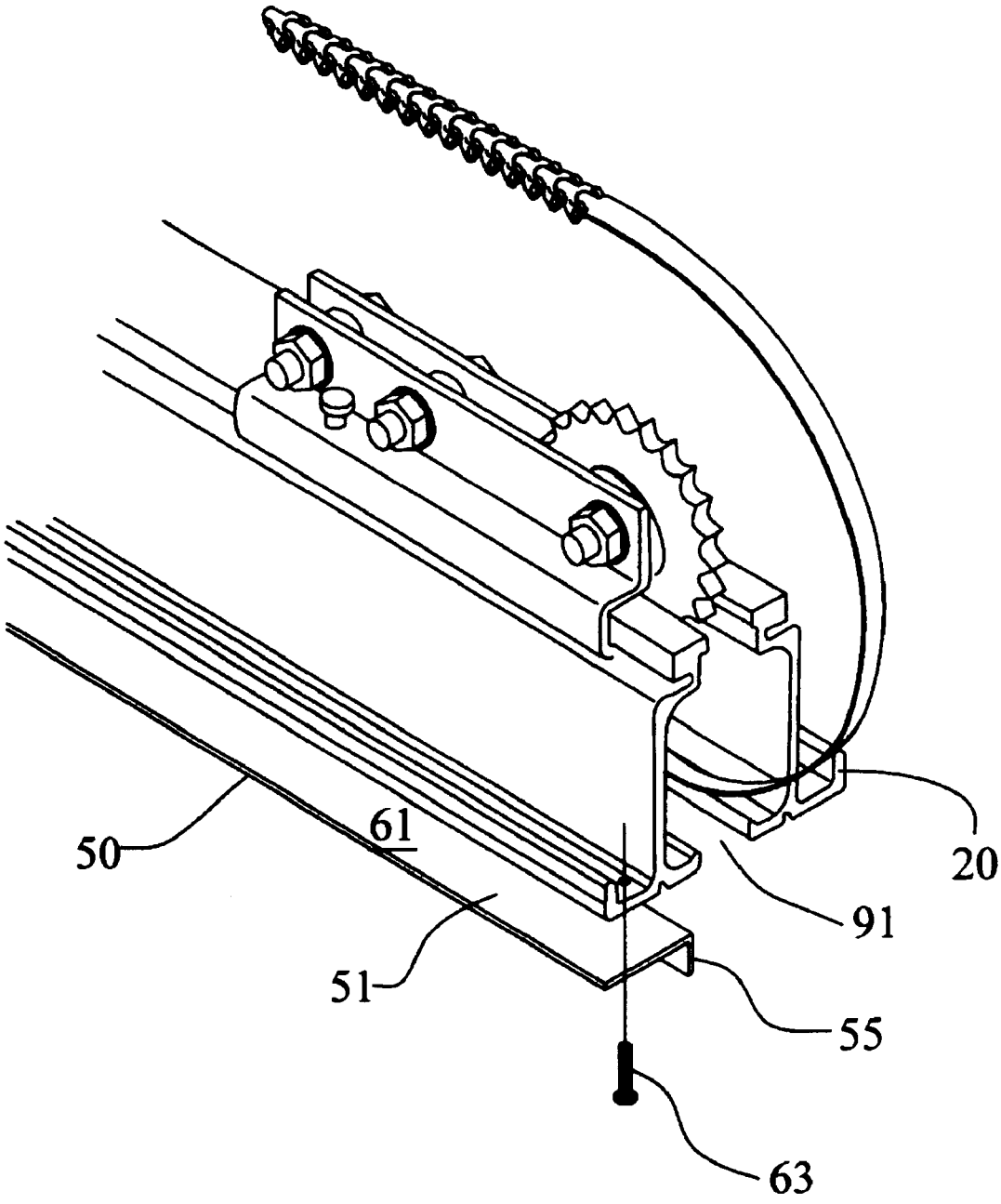
FIG. 5 is an exploded view showing the flattener member mounted to the track assembly.

In the exemplary embodiment depicted in FIG. 3, slot 91 is defined by track bottom 23. Slot 91 spans the length of track 20 and allows hanger device 48 to attach supporting trolley 90 to wall panel 30. As shown in FIG. 5, guide flange 55 is positioned along a side of slot 91. The side of slot 91 where guide flange 55 is positioned is determined by leading side 41 of first panel 40. FIG. 1 shows movable wall system 10 with leading panel 40 that has leading edge 41 which swings from a stowed position nearest front face side 45 of wall panel system 20. Guide flange 55 may be advantageously positioned on the side of slot 91 from which leading side 41 of first panel 40 swings, thus in FIG. 1 front-facing or near side 24 of track 20.

Figure 4:
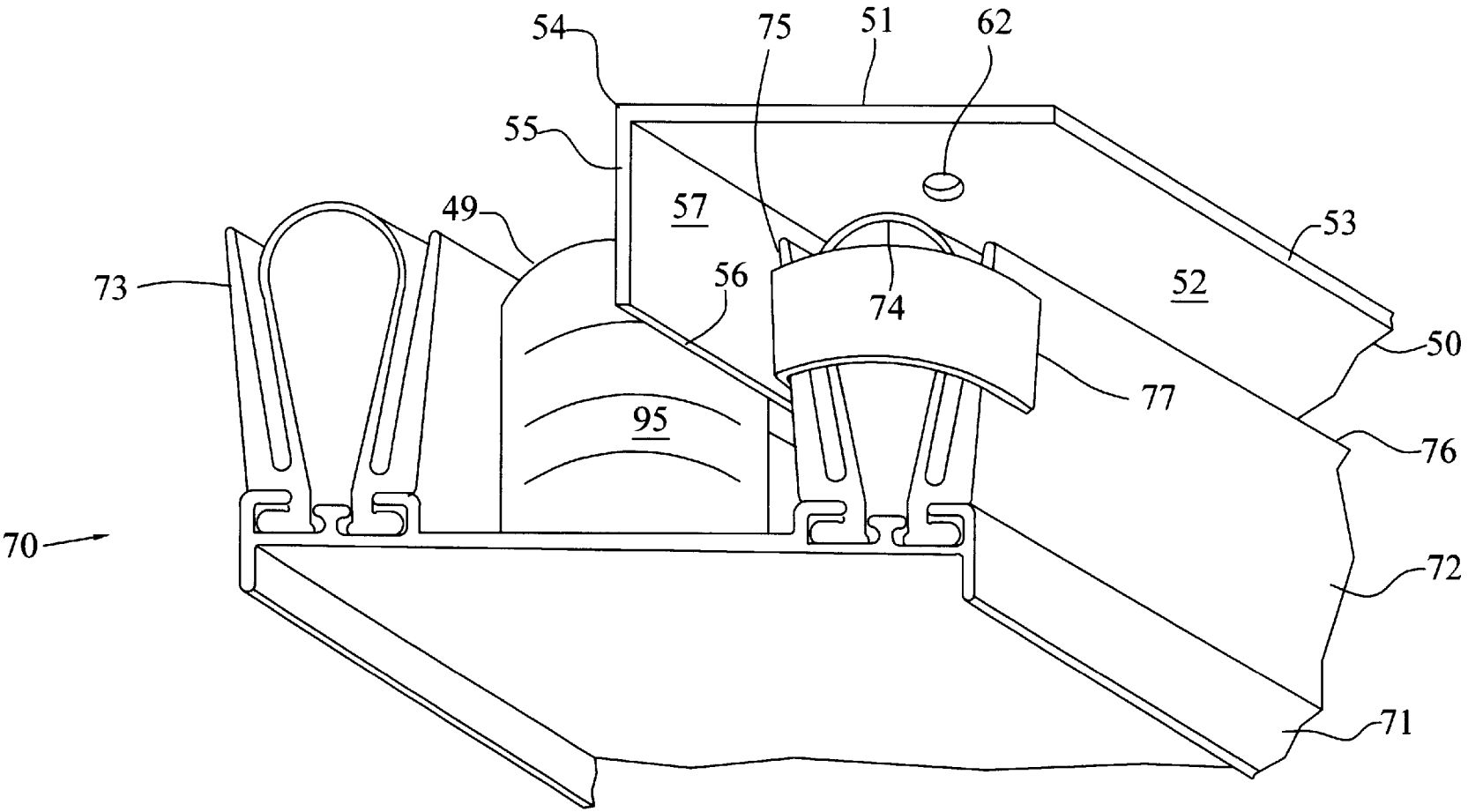
FIG. 4 is a perspective view of a panel sweep assembly engaged with the flattener member.

Fastener member 50 depicted in FIG. 4 includes base flange 51 and guide flange 55 which form an angle and join at junction 54. Base flange 51 has base sealing face 52 oriented away from track bottom 23 and toward top end 42 of wall panel 30. In addition, base flange 51 may have mounting holes 62 defined therethrough. Guide flange 55 has guide edge 56 oriented toward top end 42 of wall panel 30, and guide sealing face 57 oriented toward front face 45 of panel 30. Guide sealing face 57 and base sealing face 52 may be advantageously substantially perpendicular to each other. Flattener member 50 may be constructed of extruded aluminum, steel, or from other rigid material.

In a further aspect of the invention, the flattener apparatus can include sweep assembly 70 (FIGS. 3 and 4). Sweep assembly 70 seals the area between top end 42 of wall panel 30 and bottom side 23 of track assembly 20, and also defines one side 75 of vertical channel 80. Sweep assembly 70 may include sweep mounting bracket 71 and front 72 and rear 73 sweep. Sweep assembly 70 may include exterior seal 76, top seal 74, and interior seal 75. When wall panels 30 are in the extended position and guide flange 55 is received by vertical channel 80, interior seal 75 is contiguous with guide sealing face 57 and top seal 74 is contiguous with base sealing face 52.

According to one embodiment, vertical channel 80 is further defined by at least one guide pin 49 protruding from top end 42 of wall panel 30. As shown in FIGS. 3 and 4, guide pin 49 is advantageously located centrally between front face 45 and rear face 46 of wall panel 30 and in line with hanger 48. Guide pin 49 may include curved low-friction surface 95 for contacting and following guide flange 55. Each wall panel 30 may have single guide pin 49 or a plurality of guide pins substantially in line with hanger 48. The space between guide pin 49 and interior seal 75 of sweep assembly 70 defines vertical channel 80 which receives guide flange 55. As the continuously hinged wall panels 30 extend and engage guide flange 55, guide pin 49, sweep assembly 70, and guide flange 55 cooperate to hold wall panels 30 in alignment with track 20, forming an extended flat wall.

Guide pin 49 may advantageously include low-friction surface 95 for contacting and guiding guide flange 55 into channel 80 as panel 30 translates. Low-friction surface 95 is lubricious so that it minimizes drag applied to panel 30 as guide flange 55 contacts guide pin 49. According to an alternative embodiment, guide pin 49 is rotatably attached to panel 30. Thus, guide pin 49 rotates as panels 30 translate along track 20. To prevent sweep 72 from turning inward toward guide pin 49 as guide flange 55 is received by channel 80, sealing sweep 72 may include clip 77 on at least one end of sealing sweep 72 that tends to deflect sweep away from guide flange 55.

While the invention has been illustrated and described in detail in the drawings and foregoing description, the same is to be considered as illustrative and not restrictive in character. It should be understood that only exemplary embodiments have been shown and described and that all changes and modifications that come within the spirit of the invention are desired to be protected.

What is claimed is:

1. A movable wall panel system comprising:

a plurality of movable wall panels;

a track assembly including a track;

a plurality of hangers for movably coupling said movable wall panels to said track assembly along said track; and a flattener apparatus for holding said movable wall panels in an extended and aligned orientation, said flattener apparatus comprising:

a flattener member extending along a portion of said track, said flattener member having a base flange attached to said track and at least one guide flange vertically depending from said base flange;

a sealing sweep extending along a portion of a top end of the movable wall panels; and a vertical channel defined between said sealing sweep and said plurality of hangers, said vertical channel arranged to receive said guide flange, said guide flange aligning said movable wall panels with the track as said plurality of panels are moved along said track assembly into said extended orientation.

2. The movable wall panel system of claim 1, further comprising at least one guide pin protruding from a top end of each said movable wall panel, said guide pin disposed on a first side of said channel, and said sealing sweep disposed on an opposite side of said channel.

3. The movable wall panel system of claim 2, wherein:

said guide flange has a guide sealing face contiguous to an interior portion of said sealing sweep;

said base flange has a base sealing face contiguous to a top portion of said sealing sweep; and said guide sealing face and said base sealing face are relatively transverse.

4. The movable wall panel system of claim 3, wherein:

said guide pin includes a low-friction surface contacting and guiding said guide flange into said channel as said movable wall panel translates along said track.

5. The movable wall panel system of claim 4, wherein said guide pin is rotatably attached to said movable panel.

6. The movable wall panel system of claim 4, wherein:

said sealing sweep includes a clip on at least one end deflecting said sealing sweep away from said guide flange and said guide pin when said movable wall panel translates relative to said guide flange.

7. The movable wall panel system of claim 6, wherein:

said base flange defines holes; and further comprising fasteners attaching said base flange to bottom side of said track.

8. The movable wall panel system of claim 7, wherein:

said flattener apparatus comprises an aluminum-extruded member.

9. The movable wall panel system of claim 7, wherein:

said flattener apparatus comprises a steel member.

10. A movable wall panel system comprising:

a plurality of continuously hinged wall panels;

a track assembly having a track with a stack portion of said track for storing folded wall panels, an extension portion of said track adjacent to said stack portion for unfolding and extending said wall panels, and a remaining portion of said track adjacent to said extension portion for supporting the extended said wall panels; and a plurality of hangers coupling said plurality of continuously hinged wall panels to said track assembly;

a flattener apparatus for holding said wall panels in an extended orientation aligned with said track, having a flattener member attached to a bottom of said track assembly and spanning said remaining portion of track, said flattener member having a guide flange along its length that protrudes vertically downward toward a top end of said wall panels;

wherein said wall panels have a vertical channel defined by said top end of said wall panels for receiving said guide flange when said panels are moved through said extension portion of said track to said remaining portion of said track.

11. The movable wall panel system of claim 10, wherein: each said walls panels has a thickness between opposing front and rear wall forming faces and, said stack portion of track has a length that is approximately equal to at least the total thickness of all of said wall panels in a folded and stacked orientation.

12. The movable wall panel system of claim 11, wherein:

said stack portion has a length about nine inches greater than said total thickness of said wall panels in said folded and stacked orientation.

13. The movable wall panel system of claim 10, wherein:

said extension portion of track has a length that is equal to at least about 2.5 times the width of one extended wall panel.

14. The movable wall panel system of claim 10, further comprising:

a sealing sweep that protrudes vertically along the top end of the panels, said sealing sweep defines a side of said vertical channel closest to a front face of said wall panels; and at least one guide pin which protrudes vertically from said panels at a point between said sealing sweep and a rear face of said panels, said guide pin defines an opposite side of said vertical channel.

15. A track assembly for a movable wall system including a wall panel having a top end defining a vertical channel, a trolley, and a hanger attaching the wall panel to the trolley, the track assembly comprising:

a track configured to receive the trolley and having a bottom side, said bottom side defining a slot extending a length of said track and configured to receive the hanger; and a flattener member attached to said bottom side of said track adjacent said slot and extending a portion of the length of said track, said flattener member having a guide flange protruding vertically downward for receipt into the vertical channel of the wall panel.

16. The track assembly of claim 15 wherein: said flattener member is attached to said bottom side of said track adjacent to a side from which the wall panel swings when the wall panel is extended from a folded position.

* * * * *